US005497901A

United States Patent [19]

Chen

[11] Patent Number: 5,497,901

[45] Date of Patent: Mar. 12, 1996

[54] STRUCTURE FOR AUTOMATED STICKING OUT AND RETREATING OF PIPETTE TO A CANTEEN BY TURNING

[76] Inventor: Cin-Chen Chen, No. 35, Lane 108, Chien Pin 8 Street, Tainan City, Taiwan

[21] Appl. No.: 511,368

[22] Filed: Aug. 4, 1995

[51] Int. Cl.[6] ..... B65D 47/12

[52] U.S. Cl. ..... 220/708; 220/709; 215/388

[58] Field of Search ..... 220/703, 705, 220/707, 708, 709, 714, 715, 719; 215/388

[56] References Cited

U.S. PATENT DOCUMENTS

| | | | |
|---|---|---|---|
| 4,448,316 | 5/1984 | Hiroshige | 220/708 |
| 4,852,762 | 8/1989 | Chou-Sheng | 220/709 |
| 4,925,040 | 5/1990 | Wang | 215/388 |
| 5,150,815 | 9/1992 | Saklad | 220/708 |
| 5,265,757 | 11/1993 | Wu | 220/709 |
| 5,282,541 | 2/1994 | Chen | 220/709 |
| 5,337,918 | 8/1994 | Wang | 220/709 |
| 5,339,982 | 8/1994 | Tardie | 220/709 |
| 5,346,081 | 9/1994 | Lin | 220/709 |
| 5,361,934 | 11/1994 | Spence, Jr. | 220/709 |
| 5,465,866 | 11/1995 | Belcastro | 220/709 |

*Primary Examiner*—Stephen J. Castellano

*Attorney, Agent, or Firm*—Morton J. Rosenberg; David I. Klein

[57] ABSTRACT

A structure for automated sticking out and retreating a pipette of a canteen includes a canteen, a canteen cover and a turning cover. A washer is threaded to the hollow, semi-spherical canteen. A bore penetrating the center of a tangent surface at the frond end of the canteen to allow both pipette base and fixing sleeve hold the pipette in position. At one side of the bore is a hollow snapping base with a ventilation outlet on it. In the turning cover which shreds onto the canteen cover, a snapping tab is provided and said pipette sticks out of a circular opening on the turning cover whereby the snapping tab pushes against the pipette to bend into the snapping base for closing up the ventilation outlet thus to achieve a complete leak-proof result and easy operation of the canteen.

1 Claim, 5 Drawing Sheets

STRUCTURE FOR AUTOMATED STICKING OUT AND RETREATING OF PIPETTE TO A CANTEEN BY TURNING

BACKGROUND OF THE INVENTION

1. Field of the Invention

This Invention relates to a structure for automated sticking out and retreating of pipette to a canteen, and more particularly to a new model of structure allowing easy operation, suction and water-tight of a canteen.

2. Background of Prior Art

Many of the canteens of various types available in the market generally are each supplied with a cup. One has to open up the canteen and pour the contents into the cup thus it is very inconvenient to the user with both hands occupied with something else or to the children as well. Recently, the modified design by incorporating a pipette to the canteen as illustrated in FIGS. 5 & 6 have been available. The prior art as shown in FIG. 5 involves the earlier design, wherein the absence of ventilation outlet making one feel difficult to sip with the pipette; also, since the pipette is retreated by turning the cover to bend it for closing up, the leak proof result is poor. Furthermore, the pipette inserted within the space of the lid is vulnerable to be torn away by kid. Generally, said prior art is found inconvenient to operate and use. The prior art as illustrated in FIG. 6, though a wider range of considerations having been taken into, has a leak-proof rubber ring seal provided at the bottom of the cover; it creates extra resistance upon turning said cover, and the cover has to be turned to a certain position for connecting both suction outlet and ventilation outlet to allow sipping.

SUMMARY OF THE INVENTION

It is the primary object of the present invention to provide a canteen with a two-section pipette to automatically stick out and retreat.

It is an other object of the present invention to provide a canteen with two-section pipette to close up the ventilation outlet to assure leak-proof when said pipette is retreated.

It is a further object of the present invention to provide a canteen with a two-section pipette which is easy to operate, sip and stay fast to the canteen.

DETAILED DESCRIPTION OF THE PREFERRED EMBODIMENT

Figure 1:
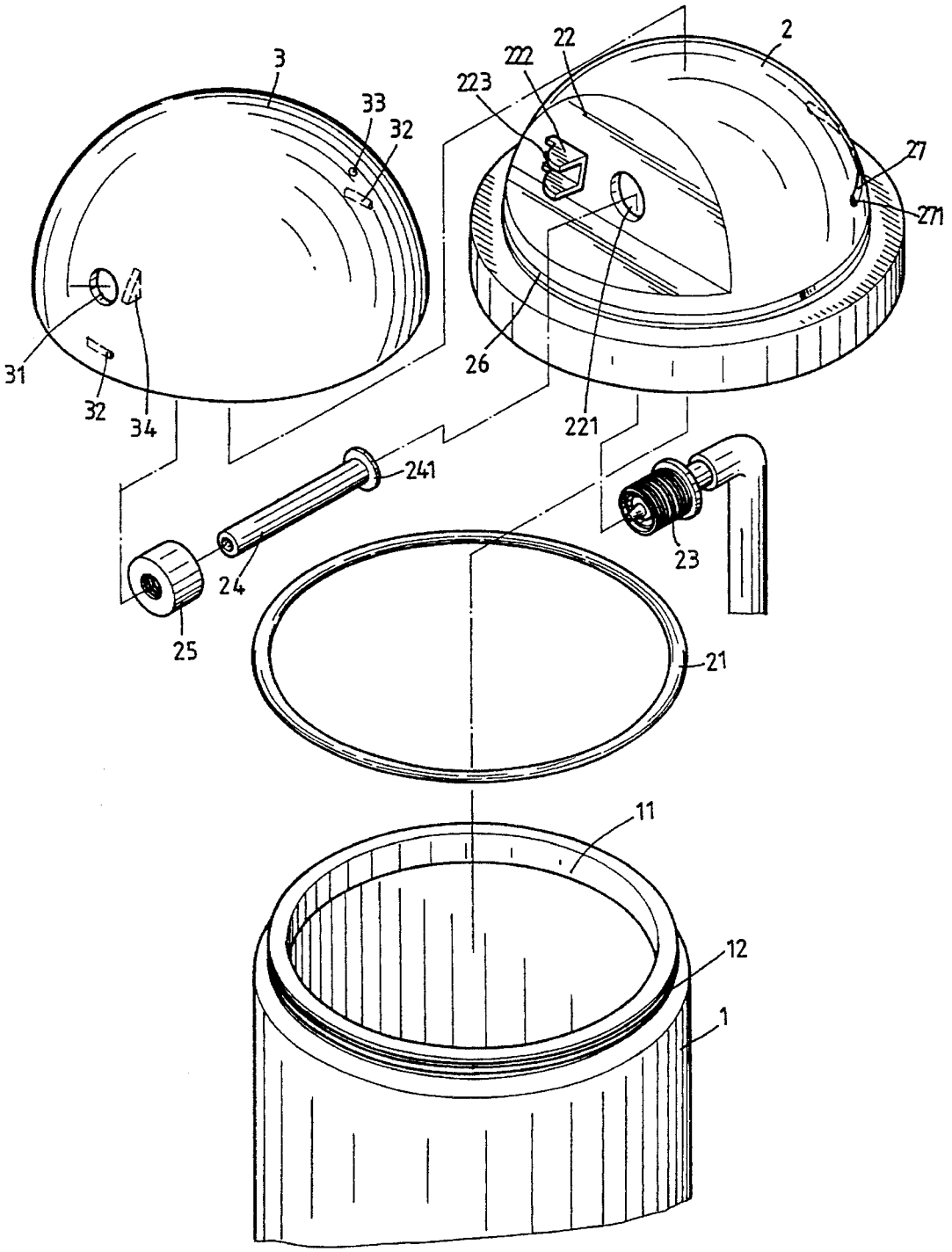
FIG. 1 is the exploded view of the present invention.

Referring to FIG. 1, there shows the present invention comprises a canteen(1), a canteen cover(2) and a turning cover(3), wherein, the outer circumference of the opening(11) at the top of said canteen(1) is provided with threads(12); a leak-proof washer(21) is inserted within the bottom of said hollow, semi-spherical canteen cover(2) and a bore(221) is provided at the center of a tangent surface(22) at the front end. Said canteen cover(2) will accommodate a pipette base(23) and a pipette(24). A fixing sleeve(25) is threaded externally to the front end of said pipette base(23) while the other end of said pipette(24) extends outward to form a protruding ring(241) setting against the interior of said fixing sleeve(25) with said pipette protruding from said bore(221) at the canteen cover(2). A hollow sector snapping base(222) with a ventilation outlet(223) is separately provided at the side to said tangent surface(22). A snapping chute(26) is disposed at the bottom circumference of and a guiding rail(27) behind said canteen cover(2). A positioning recess(271) is provided at the farther end of said guiding rail(27).

The tuning cover(3) is a hollow, circular cap with a circular opening(31) cut into its surface to accommodate a pipette(24) while two protruding tabs(32) are provided at the inside bottom circumference with both facing each other. Inside said turning cover(3) at where corresponding to the guiding rail(27) at the canteen cover(2) is provided with a pop-up solid ball(33), and at where corresponding to snapping base(222) on said canteen cover(2) is disposed with a snapping tab(34) protruding from sad snapping base(222).

Figure 2:
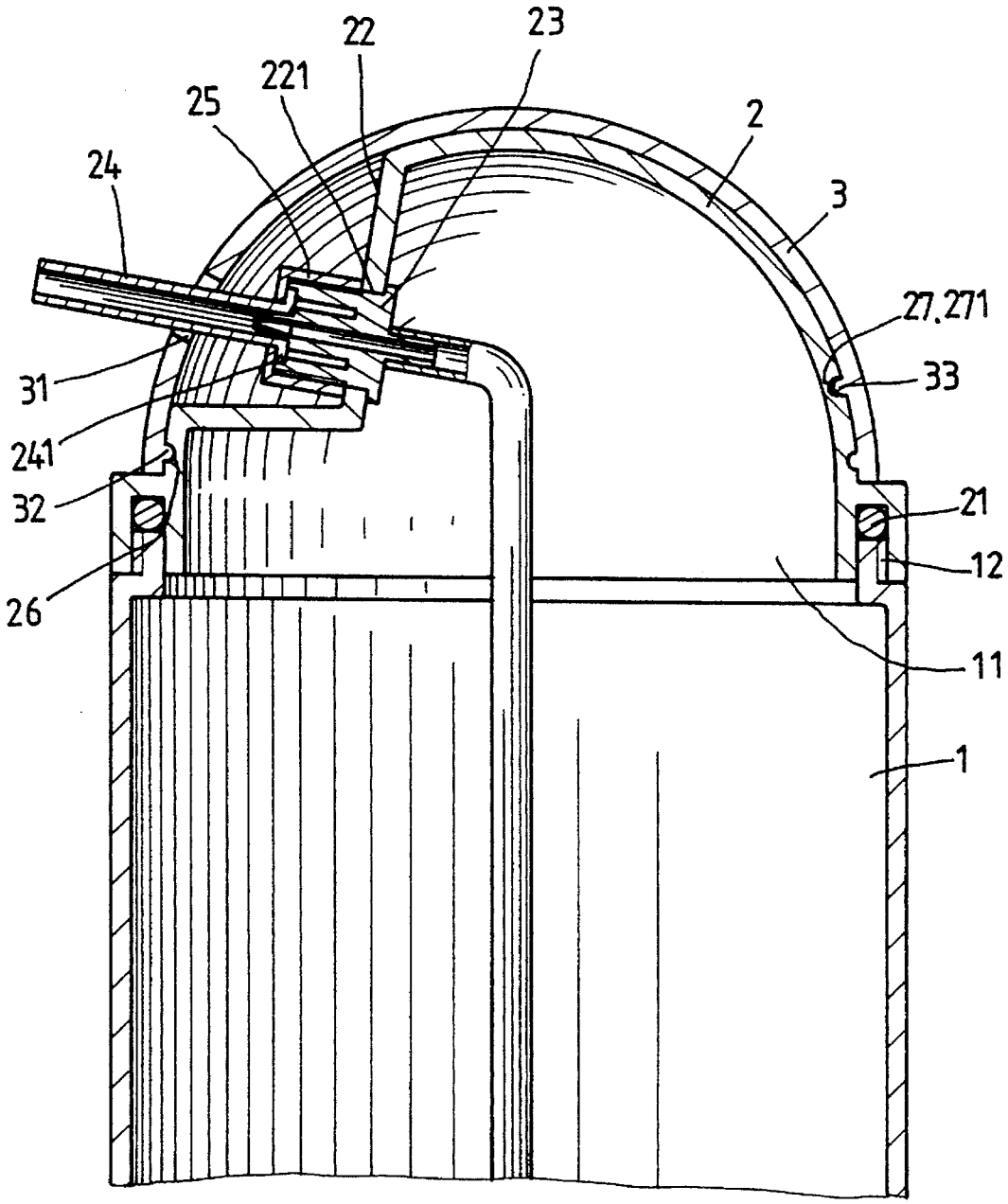
FIG. 2 is the sectional view of the present invention when assembled.

Upon assembling the present invention as illustrated in FIG. 2, the pipette base(23) is inserted from within at where the bore(221) penetrating through the canteen cover(2); the pipette(24) penetrates through the fixing sleeve(25) and holds against the inner side of said sleeve(25) with protruding ring(241) which with its threads secures said fixing sleeve(25) together with said pipette(24) to said pipette base(23). The pipette(24) sticks out of the bore(221) at the canteen cover(2) which is capped with the turning cover(3). The protruding tab(32) is snapped within the snapping chute(26) on the canteen cover(2) while the pop-up ball(33) is inserted to slide within the guiding rail(27) and the pipette(24) is permitted to stick out of the circular opening(31) on the turning cover(3) to complete the assembly of the canteen cover(2). By threading the canteen cover(2) directly to those threads(12) at the top of the canteen(l) with the leak-proof washer inside the base circumference of said canteen cover(2) closing up on the opening of said canteen to attain the basic leak-proof result.

Figure 3:
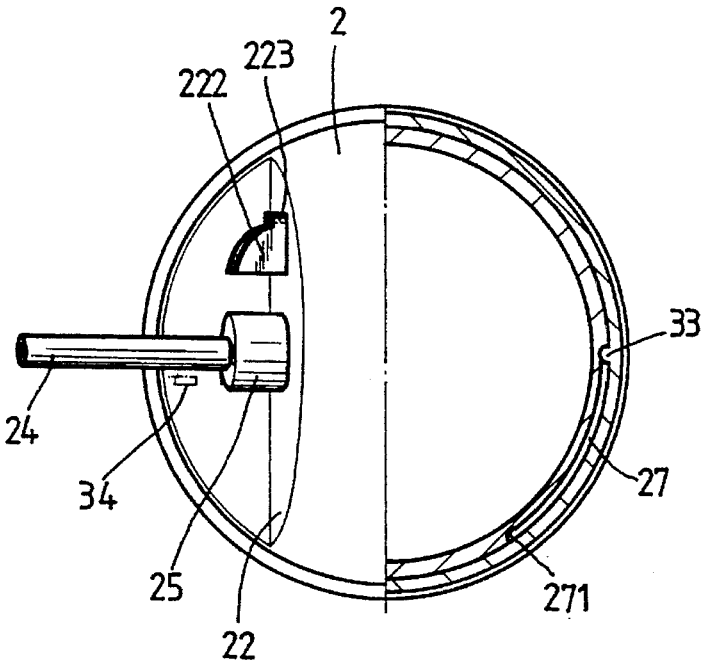
FIG. 3 is the view showing the operation of the present invention.
Figure 4:
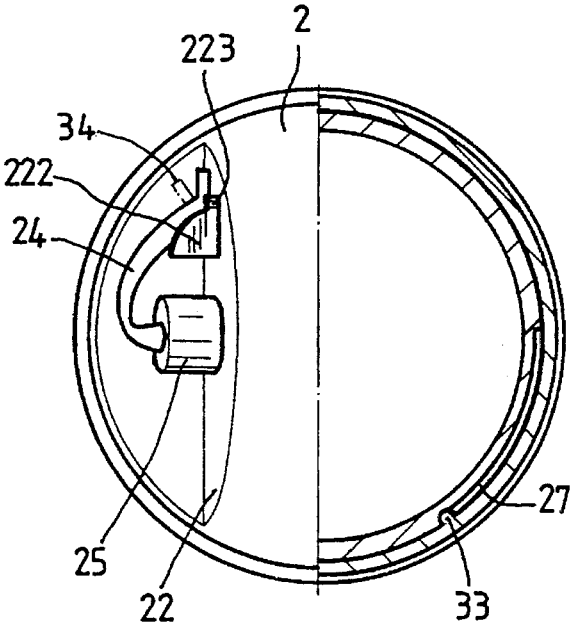
FIG. 4 is another view showing the operation of the present invention.
Figure 5:
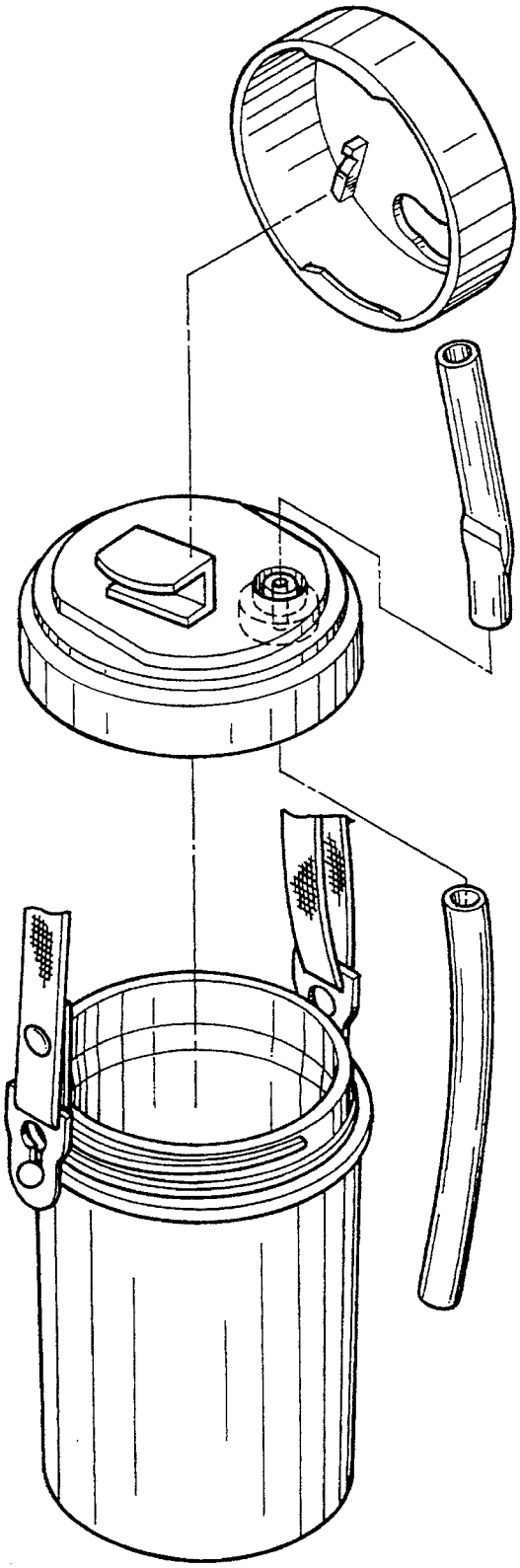
FIG. 5 (PRIOR ART)
FIG. 5 is the view of the prior art.
Figure 6:
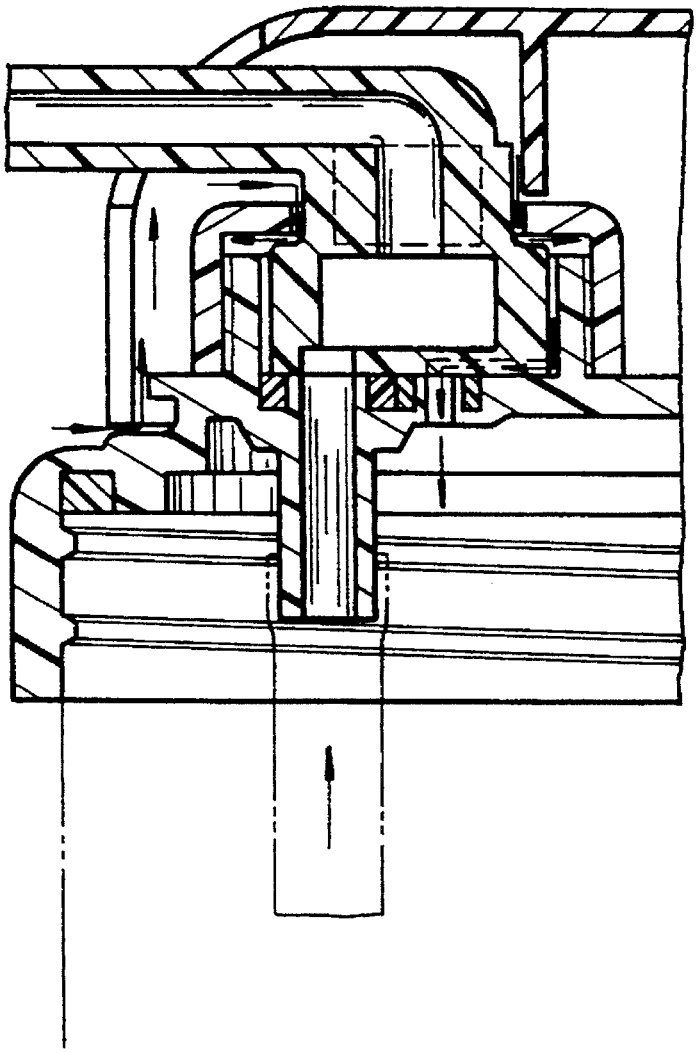
FIG. 6 (PRIOR ART)
FIG. 6 is the view of another prior art.

Referring now to FIGS. 3 and 4 wherein the showings are the retreating and sticking out by the pipette(24) of the present invention. As illustrated in FIG. 3, which is also the bird's view of FIG. 2, said pipette(24) sticks out of the circular opening(31) on the turning cover(3) and the ventilation outlet(223) is opening up for the user to sip the contents in the canteen(l) through said pipette(24). Upon completion the sipping to retreat the pipette(24), the turning cover(3) is turned and, as illustrated in FIG. 4, by using the sliding of the pop-up ball(33) in the guiding rail(27) on the canteen cover(2), the snapping tab(34) in said turning cover(3) starts to push against said pipette(24) which completes the first bending at the front end of the fixing sleeve(25). By continuing to turn said turning cover(3), the pipette(24) being pushed against by the snapping tab(34) is retreating toward the snapping base(222) to its side until the pop-up ball(3) to the turning cover(3) reaches the end of the guiding rail(27) and falls into the positioning recess(271). The pipette(24) then completes its second bending when it is forced into the snapping base(222) by the push from the snapping tab(34), and closes up said snapping base(222) by stuffing said pipette(24) outside the ventilation outlet(223). Consequently, while the pipette(24) completes its second bending and closes up the ventilation outlet(223), the position of the circular opening(31) is turned along with the turning cover(3) to meet where the canteen cover(2) indicates its semi-spherical to close up said circular opening(31) and prevents dusts or other foreign matter from invading into said canteen cover(2). If sticking out by the pipette(24) is desired, just turn the turning cover(3) counter-clockwise to retreat the snapping tab(34) and said pipette(24) by using the flexibility which holds it against the inner wall of said turning cover(3) sticks out of the circular opening(31).

By the structure as disclosed above, the present invention features 1. reliable leak-proof facilities comprising the basic leak-proof washer and the design of two-section for bending by the pipette to close up the ventilation outlet for further improvement of leak-proof result;
2. easy turning and holding in position of the turning cover respectively achieved by using the coordination of the pop-up ball and the guiding rail, and the snapping of the pop-up ball in the positioning recess;
3. convenient and facilitated operation for the pipette sticks out of the circular opening for the user to sip simply by turning to open the cover without the necessity to turn said turning cover to a certain position; and
4. the pipette is fixed to the canteen cover by being caught between the pipette base and fixing sleeve, and is further held in position with the protruding ring from the pipette to hold against within the fixing sleeve to prevent the pipette from falling off the canteen due to the biting or pulling by children.

I claim:

1. A structure for automated sticking out and retreating of pipette to a canteen by turning, comprising a canteen, a canteen cover, and a turning cover:

said canteen cover is a hollow, semi-spherical cover with its bottom circumference inserted a leak-proof washer; a tangent surface is formed at the front end of said canteen cover and a bore penetrating through at said tangent surface to allow a pipette be inserted from within; a sector of hollow snapping base is separately provided by the side to said tangent surface and a ventilation outlet is cut through said snapping base; a snapping chute is provided at the circumference at the bottom of said canteen cover and a guiding rail is provided behind said canteen cover with a positioning recess provided at the end of said guiding rail;

a circular opening is cut into at the proper place on the surface of a turning cover which is a hollow circular cap to accommodate said pipette; protruding tabs facing each other are provided at the bottom circumference within said turning cover; a pop-up ball is provided in said guiding rail corresponding to said canteen cover while a snapping tab is protruding inside said turning cover at where corresponding to said snapping base of said canteen cover; whereby, said turning cover is snapped with said protruding tab at its bottom circumference to said snapping base in said canteen cover while said pop-up ball of said turning cover is inserted to slide in said guiding rail in said canteen cover;

and said pipette sticks out of said circular opening of said turning cover to allow said canteen cover to engage threads provided on said canteen for closing up by using said leak-proof washer; said pipette completes its second bending as pushed against by said snapping tab in said turning cover when said turning cover is turned to snap said pipette into said snapping base for closing up said ventilation outlet.

* * * * *